United States Patent [19]

Utsuyama

[11] 4,050,206

[45] Sept. 27, 1977

[54] EXPANSION JOINTING MATERIAL FOR PLACING CONCRETE, MORTAR OR THE LIKE

[76] Inventor: Akira Utsuyama, No. 2-22, Toyotama-Kita, Nerima, Tokyo, Japan

[21] Appl. No.: 601,984

[22] Filed: Aug. 5, 1975

[30] Foreign Application Priority Data

Nov. 26, 1974 Japan ..... 49-143555[U]

[51] Int. Cl.[2] ..... E01C 11/10

[52] U.S. Cl. ..... 52/396; 404/48; 404/64

[58] Field of Search ..... 52/396, 573, 403; 404/48, 47, 65, 67, 68, 69, 64

[56] References Cited

U.S. PATENT DOCUMENTS

| | | | |
|---|---|---|---|
| 2,240,786 | 5/1941 | Kinzer | 404/69 |
| 3,308,726 | 3/1967 | Dreher | 404/67 |
| 3,385,017 | 5/1968 | Williams | 404/68 X |
| 3,782,846 | 1/1974 | Johnson | 404/64 |
| 3,838,930 | 10/1974 | Koch | 404/48 |
| 3,896,597 | 7/1975 | Deason | 52/396 |

FOREIGN PATENT DOCUMENTS

| | | | |
|---|---|---|---|
| 1,509,097 | 12/1967 | France | 404/64 |
| 1,409,785 | 12/1968 | Germany | 404/68 |
| 741,457 | 12/1955 | United Kingdom | 52/396 |

*Primary Examiner*—J. Karl Bell

*Attorney, Agent, or Firm*—Blanchard, Flynn, Thiel, Boutell & Tanis

[57] ABSTRACT

An expansion jointing material for placing concrete, mortar or the like which comprises a jointing material of elastic substance and a cover member placed over the jointing material and extending in the longitudinal direction thereof. In operation, a plurality of the jointing materials are preliminarily positioned and adjusted to a predetermined height along the partition lines to form a plurality of partitions into which concrete, mortar or the like is deposited to produce laid surfaces of concrete or the like using the upper portions of the cover members as the reference levels. The jointing materials are completely buried in the concrete, mortar or the like except the upper portions of the cover members to absorb or compensate for the expansion or contraction of the concrete, mortar or the like.

16 Claims, 12 Drawing Figures

EXPANSION JOINTING MATERIAL FOR PLACING CONCRETE, MORTAR OR THE LIKE

BACKGROUND OF THE INVENTION

The present invention relates to an expansion jointing material for placing concrete, mortar or the like which is capable of fully absorbing or compensating for the expansion or contraction of the deposited concrete, mortar or the like, is easily and positively settable in any place or position and is capable of easily producing smooth laid surfaces of concrete or the like.

Jointing material is an indispensable material in applications where concrete, mortar or the like is used, and a variety of jointing materials have been extensively used in offices, schools, apartment houses, factories, warehouses, parking places, platforms, underground markets, roads and other rooftops, floors, walls and roads surfaces.

concrete or mortar usually expands or contracts at a rate of $10^{-5}$ per 1° C and has a tensile stress of about 20 Kg/cm and Young's modulus of between 200,000 to 280,000 Kg/cm. Therefore, if, for example, any laid rooftop of concrete or mortar is subjected to a temperature of 60° C in midsummer, the resulting expansion or contraction amounts to as much as 200,000 Kg/cm $\times$ $10^{-5}$ $\times$ 40° C and this cannot be withstood by any means with the tensile stress of 20 Kg/cm thus causing strains or cracks. To overcome this problem, jointing material is used. While the known jointing materials have been primarily developed for the purposes of compensating for the expansion or contraction of concrete or mortar, there has still existed a need for an improved jointing material which has an improved expansion or contraction absorbing ability and which can be easily and positively installed or laid.

However, the conventional jointing materials are disadvantageous in that their ability of absorbing expansion or contraction is generally insufficient and those having a good absorbability have disadvantages of being inconvenient in handling and requiring much time and labor in laying them. For instance, while rubber jointing material has a good absorbability, it has disadvantages of being inferior in setting property, requiring much time and labor in setting, and requiring, even if it is set, an additional means to provide the required "reference" for smoothing a freshly laid surface of concrete since the material tends to be deformed by the deposited concrete. On the other hand, asphalt jointing material is also inferior in absorbing ability and is really unhandy and inefficient since its setting requires preliminary steps, namely, after preliminarily placing concrete with the aid of forms, the forms are removed from the thus laid surfaces of concrete and then the asphalt jointing material is inserted into each of the resulting grooves. One further inconvenience is that the provision of the reference requires the use of a leveling string which is stretched at every corner or the use of a plurality of studs which are projected from the laid surfaces and a vertically movable member such as a nut which is fitted on each stud to adjust the height of the stud and support between the nuts a plate for providing the required reference. As a result, to place concrete, mortar or the like over a considerably large area requires much time and labor and the resulting finished surfaces tend to produce irregularities despite the use of much time and labor. Thus, there has existed a long felt need for overcoming the foregoing deficiencies.

SUMMARY OF THE INVENTION

In accordance with the present invention, an improved jointing material is provided which overcomes the foregoing deficiencies of the prior art jointing materials.

Therefore, it is an object of the present invention to provide an improved jointing material having an improved compensating ability against the expansion or contraction of concrete, mortar or the like, that is, an ability whereby when concrete or the like expands the material tends to shrink to absorb the expansion, whereas when the concrete or the like conracts the material tends to return to its original shape to absorb the contraction.

It is another object of the present invention to provide an improved jointing material comprising two elementary component members namely, a jointing material made of an elastic member to absorb or compensate for expansion or contraction of concrete, mortar or the like and a cover member which is placed over the elastic member in the longitudinal direction thereof and whose upper surface is formed with reference levels or surfaces for producing laid surfaces of concrete and various additional means.

It is still another object of the present invention to provide such improved jointing material in which the cover member is further divided into a clamping section fitted on the jointing member proper and an elastic reference section formed with reference surfaces, and the reference section is slidably, detachably and replaceably fitted on the clamping section.

It is still another object of the present invention to provide such improved jointing material which is easily set in any desired position (if desired, over the entire area) of a rooftop, floor, wall or the like in preparation for the reception of concrete, mortar or the like and the height of its reference surfaces is adjusted as desired.

The foregoing and other objects, features and advantages of the invention will become apparent from the following more particular description of the preferred embodiments of the invention as illustrated in the accompanying drawings.

DESCRIPTION OF THE PREFERRED EMBODIMENTS

Figure 1:
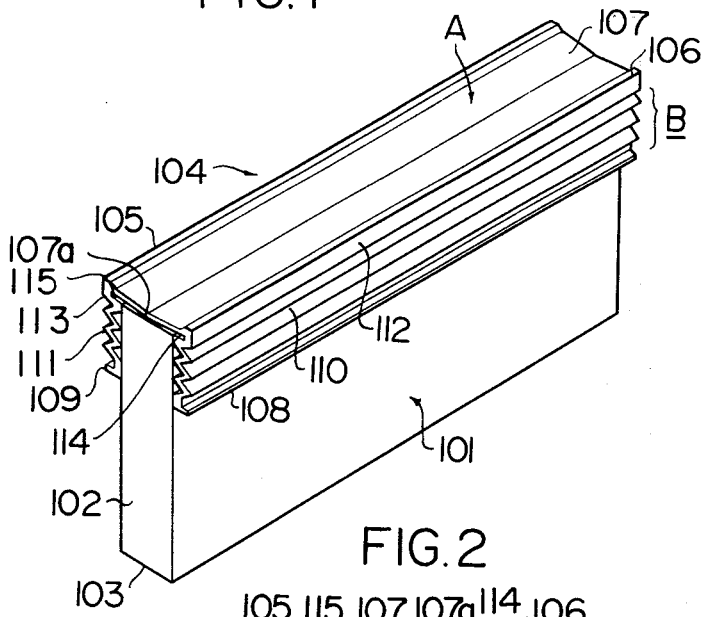
FIG. 1 is a partial perspective view showing an embodiment of a jointing material according to the invention.
Figure 2:
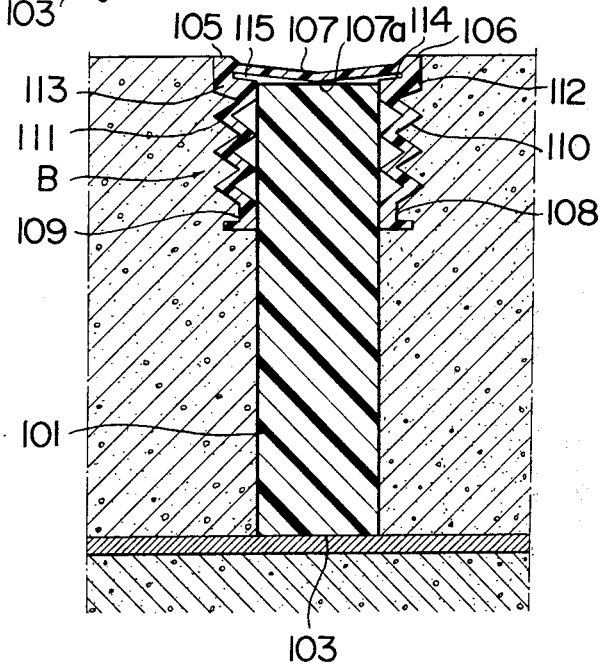
FIG. 2 is a sectional view showing the jointing material of FIG. 1 in place on a floor and concrete deposited around the jointing material.

Referring first to FIGS. 1 and 2, an embodiment of a jointing material according to the invention will be described. In FIGS. 1 and 2, numeral 101 designates a jointing material proper which is made of an elastic member such as an expanded styrol resin having a predetermined length and thickness as shown in the figures. The jointing material proper 101 is formed with a joint surface 102 at each of its ends lengthwise and it is also formed with a base surface 103 on the lower part. Each of the base and joint surfaces 103 and 102 is formed with a smooth surface so that when the jointing material is longitudinally joined with another jointing material or when the jointing material is set in place on a floor, wall or the like, the smooth plane surface ensures a close contact with the mating surface. Numeral 104 designates a cover member which is placed longitudinally over an upper portion A of the jointing material proper 101 and it is made of an elastic synthetic resin such as vinyl chloride resin member having the same length as the jointing material proper 101 and a substantially inverted U shaped cross section. The cover member 104 is formed with a projecting reference surface or level 105 and 106 on each of the longitudinal upper sides so that these reference surfaces can be employed for establishing the required laid surfaces of concrete, mortar or the like when depositing concrete, mortar or the like. Formed inside the reference side surfaces 105 and 106 is a wide V-shaped plane 107 which in turn is formed with a downwardly extending projection 107*a* at the central portion thereof. Side portions 108 and 109 which constitute a clamping section B of the cover member 104 are respectively provided with wavy side faces 110 and 111 of uneven faces which may for example be bellows like faces or dancette faces. Numerals 112 and 113 designate intermediate portions between the upper portion A of the cover member 104 and the clamping section B and the intermediate portions 112 and 113 respectively provide clearances 114 and 115 between the intermediate portions 112 and 113 and the upper section A. When the placing of concrete is completed, the clearances 114 and 115 produce cushioning effects.

A modification of the jointing material of FIGS. 1 and 2 will not be described. The cover member 104 is formed into an inverted U shape and the reference surfaces 105 and 106 are directly formed on the upper section A. However, the part of the upper section A including the reference surfaces is located above the clamping section B and this part is made of a material which is softer than the clamping section B to provide an improved compensating property against the expansion or contraction of concrete, mortar or the like. This modification will now be described with reference to FIGS. 3 and 4, in which numeral 201 designates a clamping section constituting a part of a cover member 202 and it is made of a substance such as vinyl chloride which when formed into a plate exhibits a suitable resilience against bending force. Numeral 203 designates engaging projections inwardly projecting from the lower end edges of the clamping section B and the projections 203 engage with the cut and bent protrusions of a support leg assembly that will be described later to fixedly hold the legs in place when the latter are inserted into the clamping section 201. Numeral 204 designates an elastic reference section projected and arranged in place above the clamping section 201, and the reference section 204 constitutes, along with the clamping section 201, the cover member 202. The elastic reference section 204 is protrusively formed above the clamping section 201 in the following manner. Namely, a projecting band 206 is formed on the central upper surface of an upper wall 205 and an upper elastic portion 207 is formed to extend to both sides of the upper end of the projecting band 207 in the form of a moderate V-shape. The sides of the upper elastic portion 207 are substantially inwardly bent toward the upper wall 205 of the clamping section 201 to form elastic side portions 208 and the upper end of each elastic side portion 208 is projected above the surface of the upper elastic portion 207 to form a reference surface 209. A small clearance 210 is provided between the lower end edge of each elastic side portion 208 and the surface of the upper wall 205 of the clamping section 201, and a clearance 211 is defined on each side of the projecting band 206 by the projecting band 206, the upper elastic portion 207 and the elastic side portions 208. Numeral 212 designates a rectangular jointing material proper made of an elastic substance such as sponge, Elastite or expanded styrol, and the clamping section 201 of the cover member 202 is fitted over the upper sides of the jointing material proper 212. Numerals 213 and 214 designate wavy portions formed on side walls 215 of the clamping section 201 and the outer side faces of the elastic reference portion 204. When concrete is placed, the wavy portions bite into the concrete so that water such as rainwater is prevented from leaking into the concrete below the reference surfaces 209 and at the same time an improved adhesion is ensured between the concrete or mortar and the jointing material. Numeral 216 designates a support leg assembly disposed as the occasions demand between the clamping section 201 of the cover member 202 and the jointing material proper 212. The details of the support leg assembly 216 will be described later.

The elastic reference section 204 may be modified as follows. Namely, the lower ends of the elastic side portions 208 are fixedly mounted on the upper portion of the clamping section 201 to eliminate the clearances 210, and the projecting band 206 and the upper elastic portion 207 are eliminated. In this way, the expansion or contraction of concrete may be absorbed by the inward elastic deformation of the elastic side portions 208. In still another modification, the elastic reference section 204 is provided by fixedly mounting on each side of the projecting band 206 an elastic piece made of the same elastic substance as the jointing material proper 212 such as sponge. In this case, the upper elastic portion 207 and the elastic side portions 208 are eliminated and the upper end edges of the projecting band 206 serve as the necessary reference surfaces.

Figure 4:
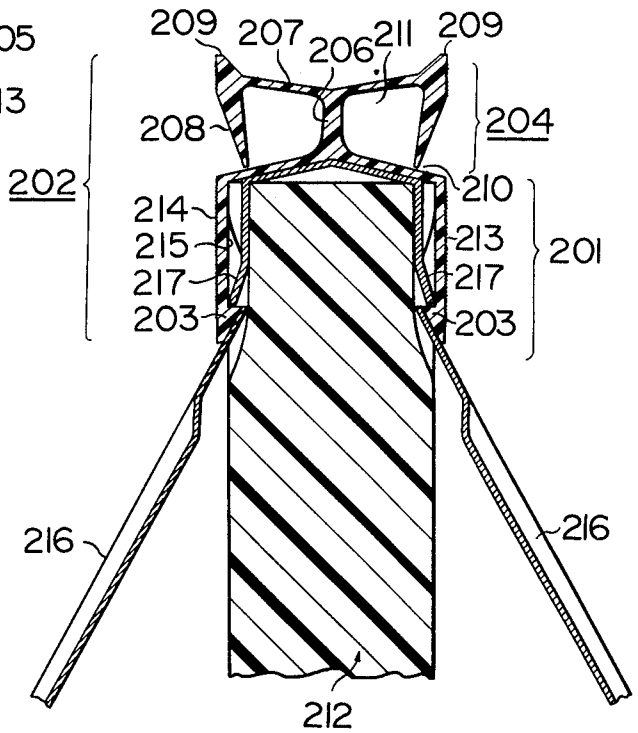
FIG. 4 is a sectional view taken along the line IV—IV of FIG. 3.
Figure 3:
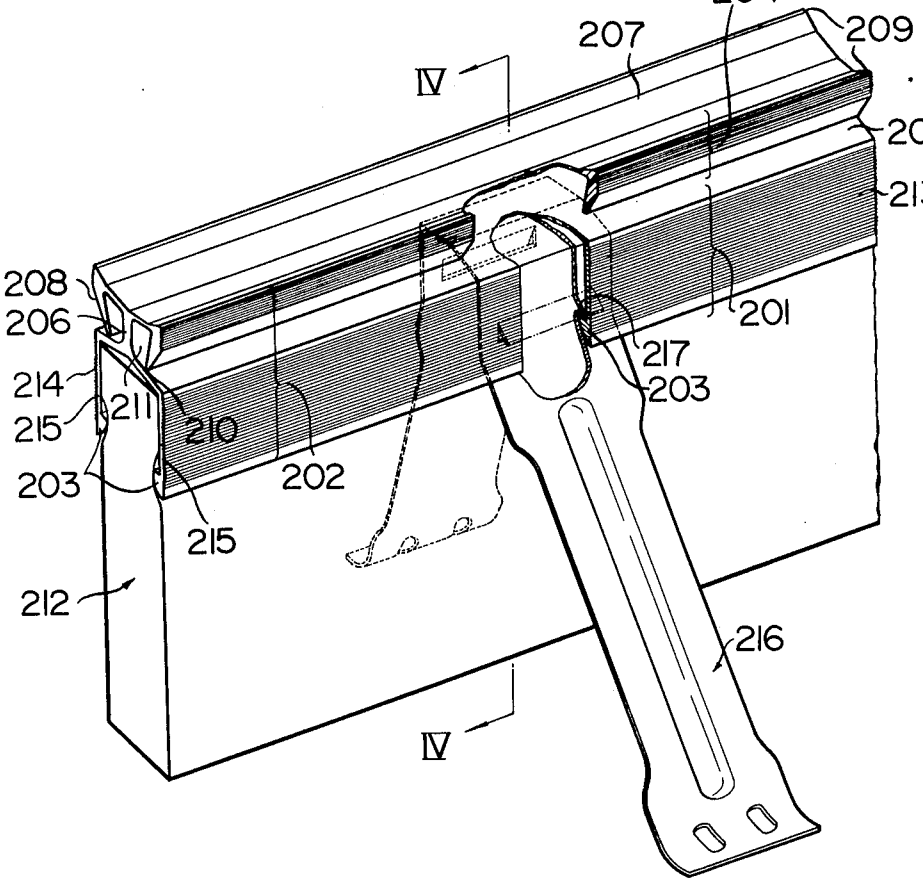
FIG. 3 is a partial perspective view showing a modification of the jointing material of FIG. 1 in which the cover member includes a clamping section and an elastic reference section.

In the jointing material shown in FIGS. 3 and 4, the reference section 204 constituting a part of the cover member 202 is made of an elastic material and the reference section 204 is made integral with and projected upwardly from the clamping section 201. However, instead of projecting the elastic reference section from the clamping section, they may be formed separately with the male and female portions which may be slidably, detachably and replaceably fitted with each other. Such forms of jointing material will now be described in reference to FIGS. 5 to 9.

Figure 5:
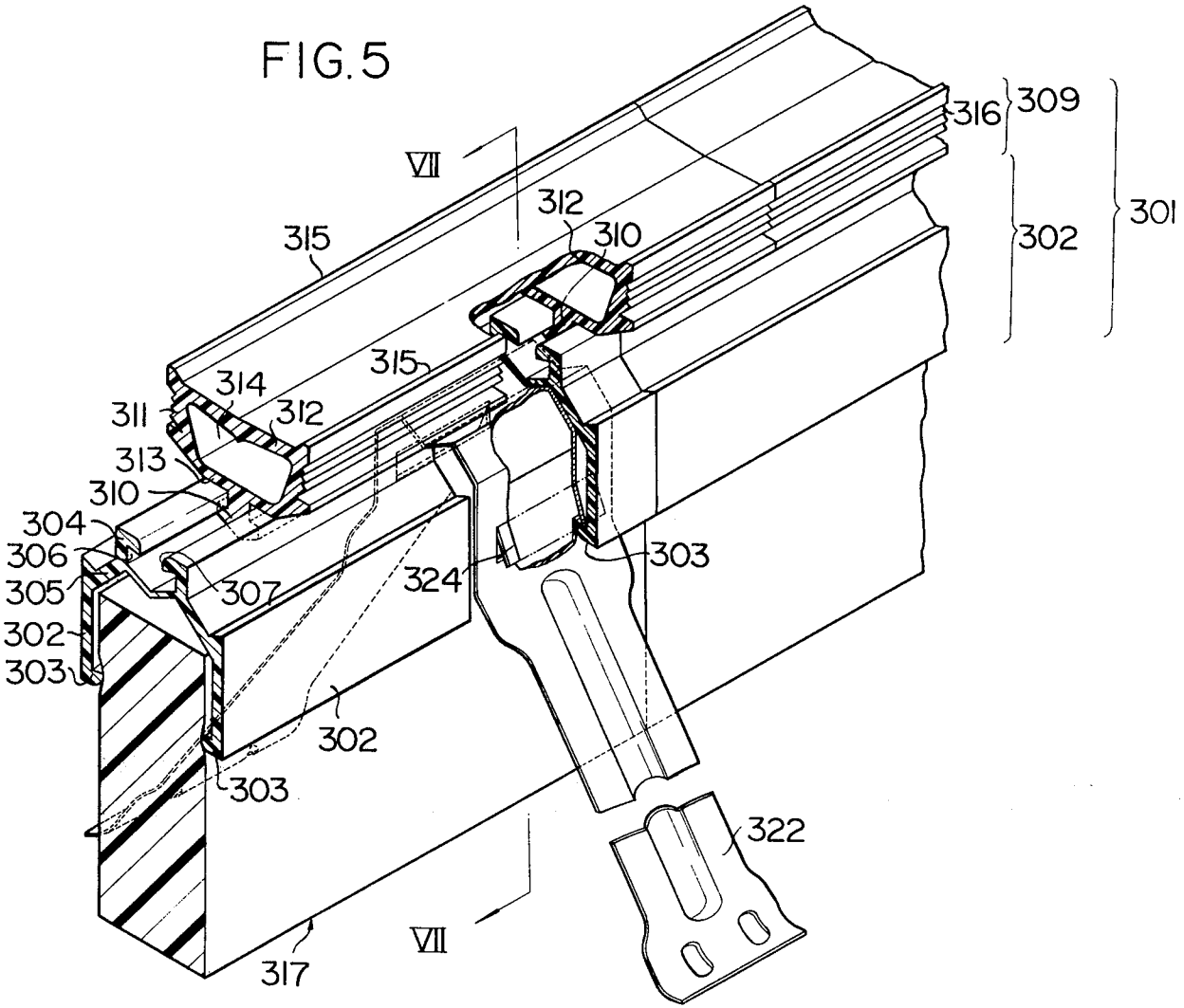
FIGS. 5 and 6 are partial perspective views showing modifications of the jointing material of FIG. 3 in which the cover member includes a clamping section and an elastic reference section which are joined together by means of male and female structures.
Figure 7:
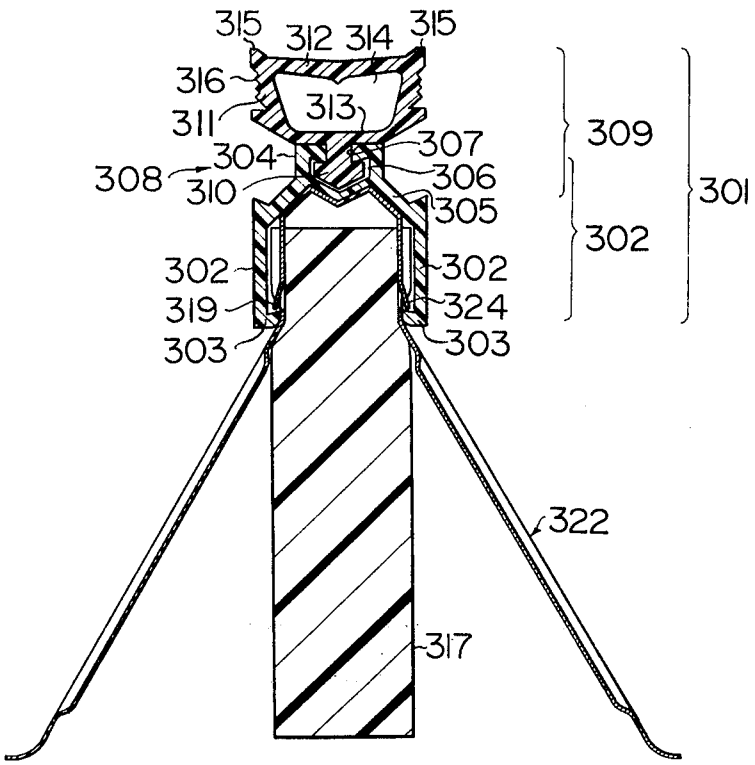

Referring first to FIGS. 5 and 7, numeral 301 designates a cover member including a clamping section 302 made of hard vinyl chloride or the like and having engaging protrusions 303 inwardly formed at its lower ends, and the upper portion of the clamping section is substantially formed into inverted W-shape or M-shape in cross section. Numeral 304 designates a pair of holding walls arranged at opposing positions on an angle portion 305 to provide a suitable engaging space 306 and the upper ends of the holding walls 304 are inwardly bent to define an insertion opening 307. These elements constitute a female half 308.

Numeral 309 designates an elastic reference section which is detachably fittable inside the engaging space 306 and it is provided on its lower portion a male half 310 longitudinally extended and arrow-shaped in cross section. The elastic reference section 309 is made of a soft elastic substance such as a soft synthetic resin which is easily deformable and recovable and it is formed into a cylindrical shape having side walls 311, an upper wall 312 and a lower wall 313 which in turn define an inner space 314. Numeral 315 designates reference surfaces projected on the upper sides of the elastic reference section 309 and these reference surfaces will be exposed flush with freshly laid surfaces of concrete after the completion of concrete placement. The upper surface of the upper wall 312 will also be exposed flush with the laid surfaces of concrete. Numeral 316 designates corrugations formed on the outer surfaces of the side walls 311 of the elastic reference section 309, and numeral 317 designates a rectangular elastic jointing material proper which is made of an elastic substance such sponge, Elastite or expanded styrol. Numeral 322 designates a support leg assembly which may be suitably inserted between the jointing material proper 317 and the clamping section 302 of the cover member. The details of the support leg assembly 322 will be described later.

Figure 9:
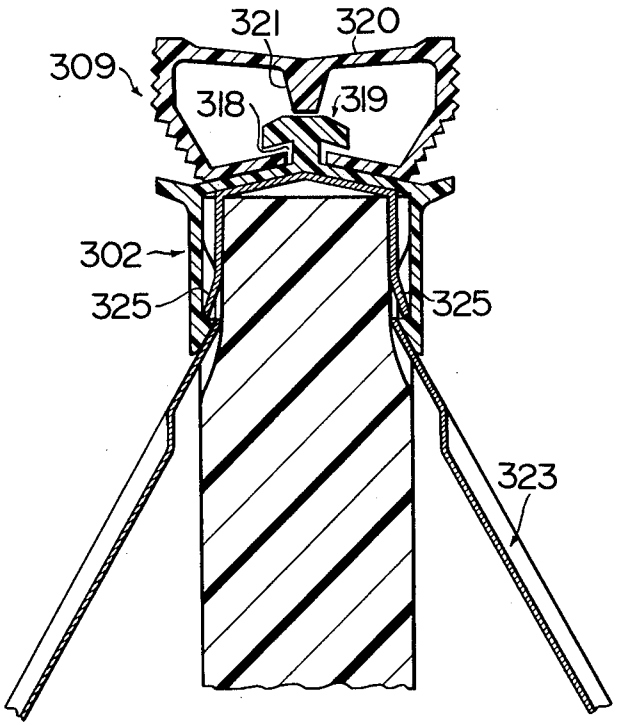
FIG. 9 is a partial sectional view showing a modification of the jointing materials shown in FIGS. 5 and 7 in which the positions of the male and female structures are reversed.

The above-mentioned male and female structures may be provided on the elastic reference section and the clamping section in the reverse relation with that of FIGS. 5 and 7. In other words, as shown in FIG. 9, instead of providng the male half 310 on the lower surface of the elastic cylindrical reference section 309, the reference section 309 may be provided with a longitudinal engaging opening 318 to provide the required female structure, while on the other hand the upper portion of the clamping section 302 may be formed into a wide inverted V-shape and a T-shaped male half 319 may be projected at the central portion of the upper surface of the clamping section 302 to extend in the longitudinal direction thereof. A holding projection 321 is formed at the central portion of the inner surface of an upper wall 320 of the elastic reference section 309 to extend in the longitudinal direction thereof and the lower surface of the holding projection 321 is positioned opposite to the upper surface of the T-shaped male half 319, so that the elastic reference section 309 is prevented from being deformed excessively when a pressure is applied to the upper surface of the elastic reference section 309. Numeral 323 designates a support leg assembly which is similar to the previously described leg assembly 322.

Figure 6:
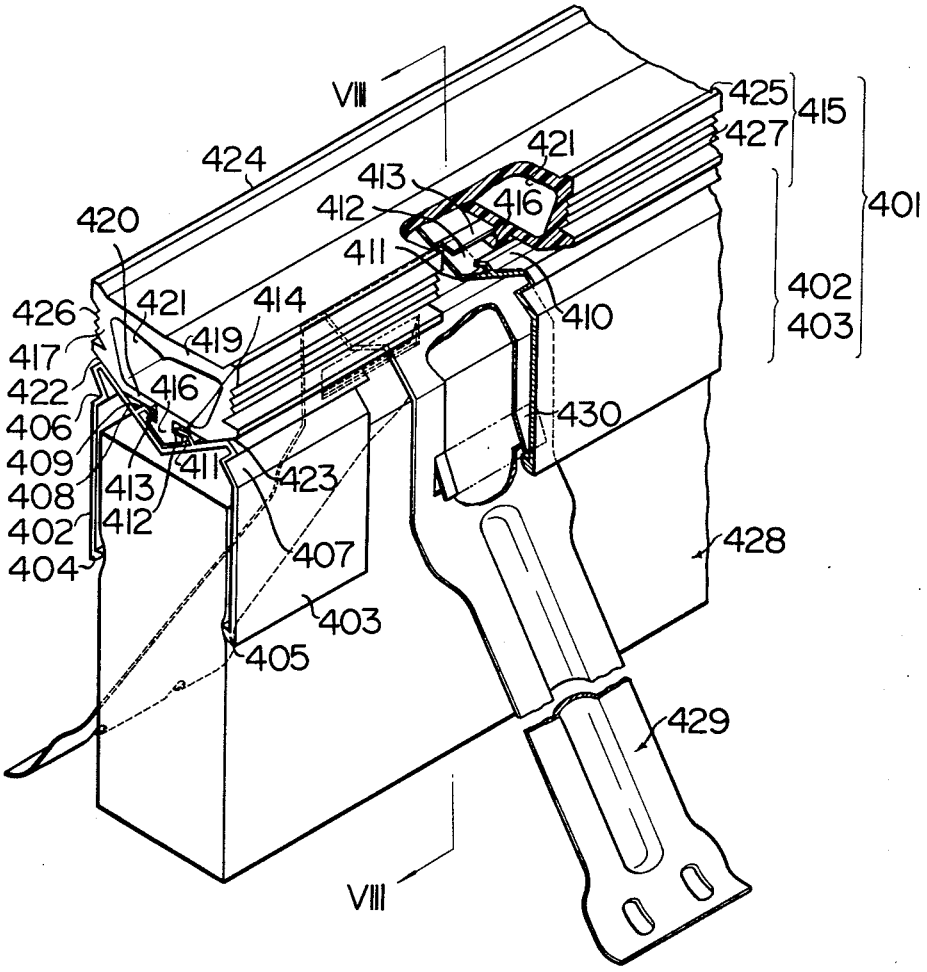
Figure 8:
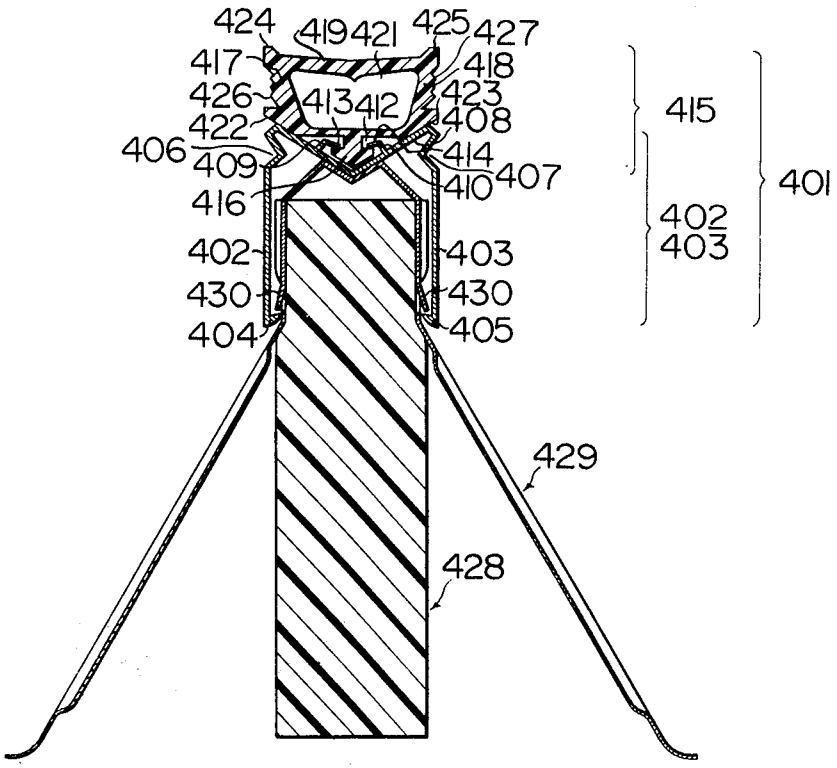
FIGS. 7 and 8 are sectional views respectively taken along the lines VII—VII of FIG. 5 and the line VIII—VIII of FIG. 6.

In the embodiment shown in FIGS. 6 and 8, the jointing material is designed so that the upper portion of a clamping section is shaped to easily absorb shocks applied to an elastic reference section and the upper portion itself of the clamping section is formed to serve the function of the elastic reference section when the elastic reference section has been removed from the clamping section. In other words, in FIGS. 6 and 8 numeral 401 designates a cover member having clamping portions 402 and 403 which are made of hard vinyl chloride or the like. Engaging protrusions 404 and 405 are provided at the lower ends of the clamping portions 402 and 403 to extend inwardly thereof and the upper portions of the clamping portions 402 and 403 are respectively provided with inwardly V-shaped bent portions 406 and 407. The upper ends of the clamping portions 402 and 403 form a continuous upper wall 408 which is formed into a wide V-shape. Numerals 409 and 410 designate a pair of holding walls arranged at opposing positions in the bottom portion of the V-shaped upper wall 408 to project therefrom at right angles and provide a suitable engaging space 411 in the space between the holding walls 409 and 410. The upper ends of the holding walls 409 and 410 are inwardly bent to form engaging walls 413 and 414 which define an insertion opening 412. These elements constitute a female half. The fact that the upper ends of the engaging walls 413 and 414 are located below the ends of the upper wall 408 constitute an important feature of this modification. On the other hand, numeral 415 designates an elastic reference section having an inverted T-shaped male half 416 projected from the lower surface thereof for detachable engagement in the engaging space 411. The elastic reference section 415 is made of a soft elastic substance such as soft synthetic resin which is easily deformable and recoverable and it is formed into cylindrical shape having side walls 417 and 418, an upper wall 419 and a lower wall 420 which define an inner space 421. The lower ends of the side walls 417 and 418 are respectively formed with mounting faces 422 and 423 having substantially the same angle of inclination as the inclined upper surface of the upper wall 408 so that when the male half 416 is inserted into the engaging space 411, the mounting faces 422 and 423 are positioned on the outer side upper surface of the upper wall 408. Numerals 424 and 425 designate reference surfaces projected at each side of the upper surface of the elastic reference section 415 so that when concrete is placed the reference surfaces 424 and 425 are exposed and flush with the laid surfaces of concrete. In this case, the upper end surface of the upper wall 419 is also exposed on a level with the laid surfaces of concrete. Numerals 426 and 427 designate corrugations formed on the outer surfaces of the side walls 417 and 418 of the elastic reference section 415. Numeral 428 designates a rectangular elastic jointing material proper which is made of an elastic substance such as sponge, Elastite or expanded styrol. Numeral 429 designates a support leg assembly which may be inserted as occasions demand between the elastic jointing material proper 428 and the clamping portions 402 and 403 of the cover member (the details of the support leg assembly will be described later).

Figure 10:
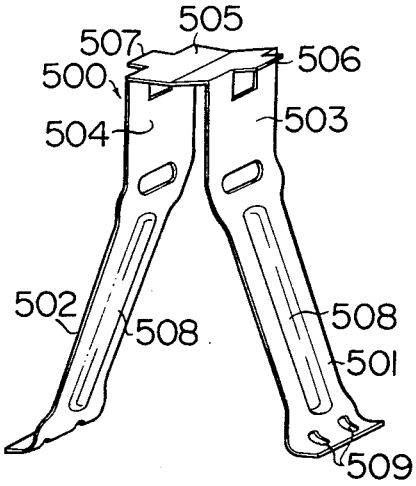
FIG. 10 is a perspective view showing an exemplary form of the support leg assembly used with the jointing material of the invention.

The jointing materials according to the embodiments of the invention which have been described so far have for their principal object the improvement of their ability to compensate for the expansion or contraction of concrete, mortar or the like, and these jointing materials may incorporate a support leg assembly of the type that will be described hereunder for setting the jointing material in place on a rooftop, floor or wall. One form of such support leg assemblies will be described with reference to FIGS. 10 and 11. A support leg assembly 500 includes a pair of adjustable leg portions 501 and 502, body portions 503 and 504 which are continuously extended respectively from the leg portions 501 and 502 and a head portion 505. The body portions 503 and 504 and the head portion 505 are substantially inverted U shaped in cross section and particularly the head portion 505 is designed to have a cross-sectional shape corresponding to the upper inner sides of the clamping portions. For instance, with the support leg assembly 500 of FIG. 10 which is designed for incorporation with the cover member 104 shown in FIGS. 1 and 2, the cross-sectional shape of the head portion 505 is formed to conform with the shape of the upper section A of the cover member 104. Since the support leg assembly 500 must be positively and stably fitted in the clamping section of a variety of cover members when it is mounted in place, a portion of each of the body portions 503 and 504 is cut and bent outwardly to provide a projecting piece. These projecting pieces are shown at 506 and 507 in FIGS. 10 and 11 and the projecting pieces 506 and 507 are respectively received into clearances 114 and 115 preliminarily provided on both sides of the clamping section. In other forms of jointing material shown in FIGS. 3, 4, 5, 6, 7, 8 and 9, the longitudinally extended inner protrusions (203, 303, 404, 405) have been preliminarily provided on the inner sides of the lower ends of the clamping section and therefore the support leg assembly (216, 322, 323, 429) is provided with the corresponding cut and bent projections (217, 324, 325, 430) for engagement with the inner protrusions. In FIG. 10, numeral 508 designates leg portion reinforcing ribs and numeral 509 designates bolting or fixing holes. Further, since the support leg assemblies (500, 216, 322, 323, 429) are similar in shape and construction, the shape and construction of the support leg assembly 500 have been described by way of example.

The jointing materials according to the above-described embodiments are set in place on a rooftop, floor or wall for placing concrete, mortar or the like in the following manner.

Firstly, the jointing material shown in FIGS. 1 and 2 is used in the following manner.

The cover member 104 is fitted on the upper portion of the jointing material proper 101 so that the sides and the upper surface of the jointing material proper 101 are covered respectively by the side portions 108 and 109 and the upper surface 107 of the cover member 104 and the cover member 104 is carried by the jointing material proper 101.

In operation, the jointing material proper 101 with the cover member 104 mounted thereon is set in place on the site through the intermediary of its sole surface 103, and a plurality of the jointing materials are successively connected lengthwise by means of their joint surfaces 102 and another plurality of the jointing materials are also successively arranged crosswise and side by side at predetermined intervals. In this case, each of the jointing materials is fixedly secured in position by means of lumps of mortar or the like which are arranged on the sides of the sole surface 102 of the jointing material proper 101 at suitable intervals, and concrete, mortar or the like is suitably deposited to become flush with the reference surfaces 105 and 106 on the upper portion of the cover member 104 (FIG. 2). Thereafter, a tool for smoothing freshly laid surfaces of concrete or the like, such as, a float or patter is slidingly moved over the reference surfaces of the parallel cover members 104 thus smoothing the laid surfaces of concrete or the like into level planes according to the reference surfaces 105 and 106 without requiring any special skill. In this case, since the reference surfaces 105 and 106 of the jointing material are projecting beyond the V-shaped surface 107, the "smoothing" of the concrete surfaces adjacent to the jointing materials is accomplished with an excellent finish. When the concrete placing is completed, by virtue of the fact that the cover member 104 having the corrugated side faces is mounted on the jointing material proper 101, the ability of the cover member 104 to deform and regain the original shape positively absorbs and compensates against the expansion or contraction of the deposited concrete. Further, since the clamping section of the cover member is corrugated, it has an improved affinity with the deposited concrete and this has, coupled with its deformability and recoverbility, the effect of preventing any separation between the deposited concrete and the jointing material. Moreover, there is an additional effect of reinforcing the cover member itself thus facilitating the handling of the jointing material. Therefore, this jointing material is best suited for use in placing concrete, mortar or the like.

Figure 11:
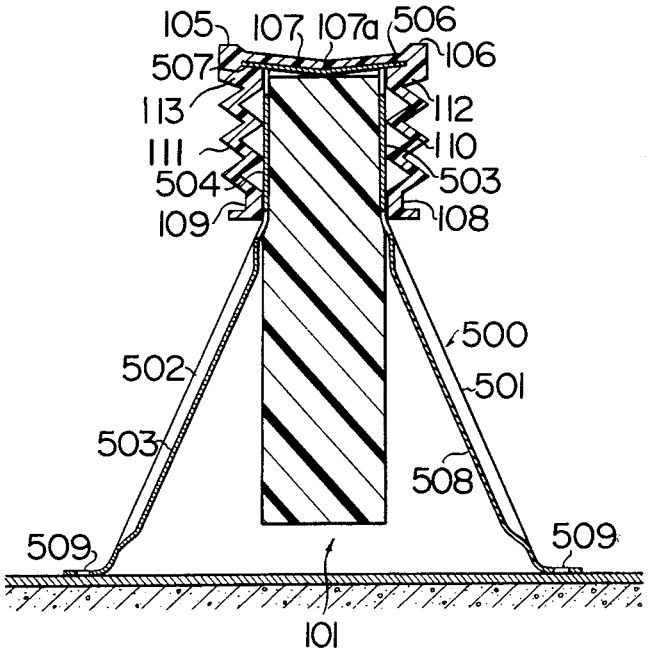
FIG. 11 is a sectional view showing the manner in which the support leg assembly of FIG. 10 is mounted in the jointing material shown in FIGS. 1 and 2.

On the other hand, where the support leg assembly 500 is incorporated in the jointing material as shown in FIG. 11, the body portions 503, 504 of the leg support assembly 500 are placed inside the cover member 104. More specifically, the leg support assembly 500 is slidingly inserted from one end of the cover member 104 into inside the clamping section B of the cover member 104 thus inserting and fitting the projecting pieces 506 and 507 of the support leg assembly 500 in the clearances 114 and 115, respectively. In practice, a plurality of the support leg assemblies 500 are fixedly mounted inside the cover member 104 at predetermined intervals. Thereafter, the upper side portions of the jointing material proper 101 are inserted and fitted in the cover member 104 through the opening at the lower end thereof and thus the cover member 104 is placed on and carried by the jointing material proper 101. In laying the jointing material, the leg portions 501 and 502 of the support leg assembly 500 are operated to adjust the height of the reference surfaces 105 and 106 and the jointing material is set in place on the surface to be covered with concrete. A set of the jointing materials each having the height of its reference surfaces adjusted through a plurality of the support leg assemblies are successively connected lengthwise in parallel rows and another set of the similar jointing materials are successively arranged crosswise between the parallel jointing materials at predetermined intervals to lay the jointing materials at right angles to each other. Thereafter, concrete, mortar or the like is placed in the previously mentioned manner. Thus, by virtue of the fact that the jointing materials are supported by the support leg assemblies, the set height of the reference surfaces may be easily adjusted to meet the requirements of the site and moreover the jointing materials may be used in any desired positions thus improving the operating efficiency.

With the jointing material shown in FIGS. 3 and 4, the head portion and the body portions of each support leg assembly 216 are inserted into the clamping section 201 of the cover member so that while in the course of this process the bent projections 217 of the support leg assembly are inwardly pressed by the engaging protrusions 203 of the clamping section, the bent projection 217 are positively engaged and fixed in place by the engaging protrusions 203 and eventually the leg assembly 216 is engaged fixedly downwardly of the sides of the cover member 202. Then, the upper side portions of the jointing material proper 212 are compressively inserted into the support leg assemblies and the clamping section 201 of the cover member 202. While the elastic jointing material proper 212 may be bonded inside the cover member 202 by means of an adhesive, the use of adhesive is not always required since the jointing material proper 212 is held in place by virtue of the recovering property of the jointing material 212 itself which is clamped by the support leg assemblies 216 and the clamping section 201.

After the cover member, the jointing material proper and the support leg assemblies have been assembled together in the manner described above, the placing of concrete, mortar or the like is accomplished by using the jointing materials in the same manner as the jointing material of FIGS. 1 and 2.

While the thus placed and set concrete, mortar or the like expands or contracts depending on the various surrounding conditions such as humidity and dryness, the expansion or contraction of the concrete placed belows the lower surface of the cover member 202 is absorbed by the jointing material proper 212, while the expansion or contraction of the concrete placed in the vicinity of the sides of the cover member 202 is absorbed by the elastic displacement of the clamping section and the elastic jointing material proper 212. On the other hand, the expansion or contraction of the concrete placed in the vicinity of the upper portion of the cover member 202 or the elastic reference section 204 is positively absorbed or compensated by the fact that the elastic side portions 208 displace toward the clearances and the elastic upper portion 207 displaces upward along with the elastic side portions 208 in response to the expansion of the concrete or the like.

Figure 12:
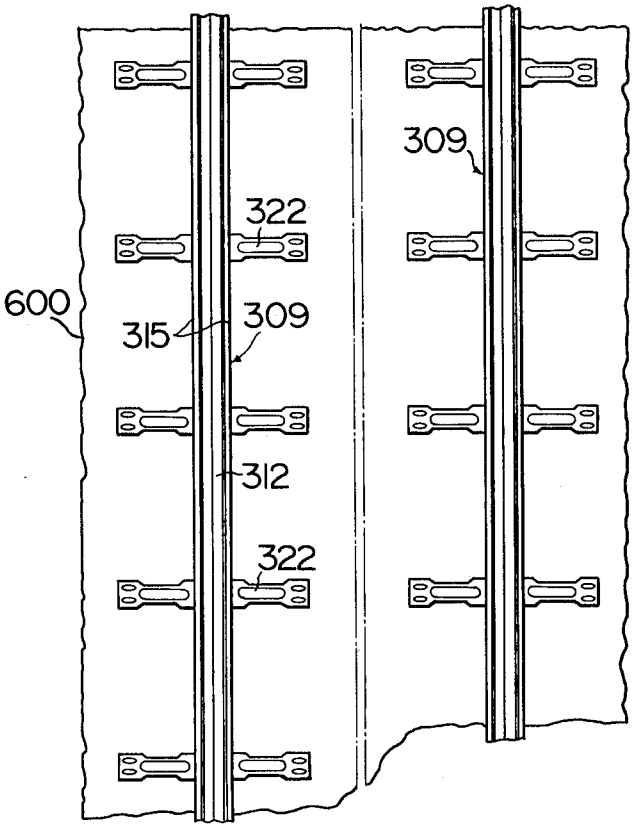
FIG. 12 is a partial plan view showing the manner in which the jointing material shown in FIGS. 6 and 8 is set in place on a floor level.

Next, the jointing materials of the type which employs separate elastic reference section and the clamping section are used in the following manner. Firstly, in the case of the jointing material shown in FIGS. 5 and 7, to set the jointing material in place on a surface 600 to be covered with concrete or mortar, such as, a floor or wall as shown in FIG. 12, the height of the reference surfaces 315 is adjusted to a desired concrete thickness with or without the aid of the support leg assemblies and a set of the jointing materials are connected together lengthwise and another set of the jointing materials are laid crosswise. In connecting the jointing materials lengthwise, instead of aligning the ends of the elastic reference section 309 and the clamping section 302 as shown in FIG. 5, the elastic reference section 309 is slid to the right in the illustration along the engaging space 306 in the female half 308 of the clamping section 302 to shift it relative to the clamping section 302 and the male half 310 of the elastic reference section 309 in another jointing material is fitted in the thus shifted engaging space 306. In this way, the pluraity of the jointing materials may be positively connected lengthwise with one another.

In this way, as shown in FIG. 12, the jointing materials are laid on the surface 600 which is to be covered with concrete, mortar or the like and the placing of concrete, mortar or the like is accomplished in the same manner as in the case of the previously mentioned embodiments. The expansion or contraction of the concrete, mortar or the like is compensated for in substantially the same manner as the previously described embodiments. In the jointing material of this embodiment, however, the clamping section 302 and the elastic reference section 309 are separately provided and moreover these sections are both detachable and replaceable. Therefore, at the expiration of a predetermined time after the jointing materials have been laid in the concrete or the like, the broken or worn reference sections may be replaced and moreover the jointing materials may be advantageously used in such applications as the floor of a parking area where the jointing materials are subjected to large impact.

The jointing material according to the embodiment of FIG. 9 has substantially the same function and effect as the embodiment of FIGS. 5 and 7 and therefore it will not be described herein.

Next, the jointing material according to the embodiment of FIGS. 6 and 8 will be described. The elastic reference section 415 and the clamping portions 402 and 403 may be engaged with each other by simply fitting their male and female structures with each other and therefore no further description will be made. To connect the jointing material to another jointing material lengthwise, the cover member is slightly displaced, particularly the elastic reference section 415 is displaced relative to the clamping portions 402 and 403 and the corresponding parts of another jointing material are engaged with the thus shifted portions in the same manner as in the previously described embodiments. The placing of concrete, mortar or the like is accomplished in the same manner as in the previously described embodiments. With the jointing material of this embodiment, however, the lower surfaces of the elastic reference section 415 are placed on the upper surface of the clamping portions 402 and 403 and consequently the expansion or contraction of the entire thickness of the deposited concrete from the upper end to the lower end may be wholly absorbed by the fact that there is no gap between the elastic reference section 415 and the clamping portions 402 and 403. Thus, the occurrence of any curves, cracks and crevices in the set surfaces of concrete may be prevented. Further, since the clamping portions 402 and 403 and the elastic reference section 415 are detachably engageable with each other, after the expiration of a predetermined time any broken or worn out reference sections may be replaced, and the jointing material of this embodiment may be used in applications such as the floor of a parking area where the jointing material is subjected to strong impact as was the case in the previously mentioned embodiment. Furthermore, since the lower surfaces of the reference section 415 are placed adjacent to the upper surface of the clamping portions 402 and 403, when impact is applied to the upper surface of the reference section 415, the impact is efficiently and positively absorbed by the clamping portions 402 and 403 along with the resiliency of the reference section 415 as mentioned earlier and consequently the damage to the reference section may be minimized even if the jointing material is used in applications such as the floor of a parking area where the jointing material is subjected to strong impact.

Further, since, as will be seen from FIGS. 6 and 8, the upper wall 408 of the clamping portions 402 and 403 is formed into wide V-shape and the holding walls 409 and 410 constituting the female half are confined within the depth of the bottom portion of the V-shape, the shape of the upper wall 408 on the whole substantially corresponds to that of the elastic reference section 415, and even if the elastic reference section 415 is removed, the upper portions of the clamping portions 402 and 403 may perform substantially the same function as the elastic reference section 415. For instance, the upper ends of the V-shaped bent portions 406 and 407 on the clamping portions 402 and 403 may be used to function in the same manner as the reference surfaces.

It will thus be seen from the foregoing description that the jointing material provided in accordance with the present invention has the advantages, such as; (1) improved compensating ability against the expansion or contraction of concrete, mortar or the like in addition to its primary functions which are far superior to those of the conventional devices, (2) any number of the jointing materials may be interconnected lengthwise as desired and the support leg assemblies may be utilized to set within a short period of time a number of the jointing materials in place over a wide area to be covered with concrete, mortar or the like, thus greatly improving the laying efficiency, and (3) the elastic reference section constituting part of the cover member may be replaced as occasions demand. Therefore, the jointing material provided in accordance with the present invention is best suited for use in the various applications mentioned earlier.

Having described my invention, what I claim as new and desire to secure by Letters Patent is:

1. A joint forming and sealing assembly adapted to be laid in place on a surface prior to forming a slab of concrete or mortar, comprising: an elongated elastic compressible jointing member having substantially the shape of a board and having upper and lower edges and opposite sides; a plurality of support assemblies located at selected longitudinally spaced-apart positions along said jointing member, each support assembly comprising an upper portion of inverted substantially U-shape cross section and a pair of support legs extending downwardly from said upper portion and diverging with respect to each other, the lower ends of said support legs being adapted to rest on said surface and being adjustable toward and away from each other to adjust the height of said upper portion, the upper portion of said jointing member being snugly received within and substantially filling said upper portion of said support assembly and being compressed thereby, said support legs diverging away from the opposite sides of said jointing member in a direction toward the lower edge thereof; and an elongated cover member extending along the entire length of said jointing member and comprising a clamping section and an elastic reference section, said clamping section comprising a pair of downwardly extending legs snugly sleeved on the exterior of said upper portions of said support assemblies and extending downwardly therealong substantially to the positions at which said support legs begin to diverge, said legs of said clamping section also snugly contacting the opposite sides of said jointing member in the zones between the support assemblies, said reference section projecting upwardly from said clamping section and defining at its upper end a pair of longitudinally extending reference surfaces for use in smoothing the surface of the concrete or mortar, said support assemblies and said cover member having interengaging means for releasably coupling same together.

2. An assembly according to claim 1, wherein said legs of said cover member are corrugated on the interior and exterior surfaces thereof.

3. An assembly according to claim 1, wherein said cover member is of inverted substantially U-shape cross section, said reference surfaces are upwardly extending projections on the edges of the base wall of said cover member and extend the entire length of said cover member, and the central portion of said base wall between said reference surfaces has the cross-sectional shape of a shallow V.

4. An assembly according to claim 1 in which said cover member is of one-piece construction, said clamping section being of inverted substantially U-shape cross section and said reference section being of upright substantially T-shape cross section, said reference surfaces being defined by upwardly extending projections located at the ends of the crossbar of the T, said reference section having side portions extending downwardly from the ends of the crossbar of the T to positions located close to but spaced upwardly from the upper surface of said clamping section.

5. An assembly according to claim 1, wherein said clamping section and said elastic reference section of said cover member are separable parts, said elastic reference section is slidably, detachably and replaceably fitted on said clamping section, and said clamping section and said elastic reference section are coupled with each other by interfitting male and female connecting structures.

6. An assembly according to claim 5, wherein said clamping section has an upper wall of inverted substantially W-shape cross section and a pair of spaced-apart opposed holding walls projecting upwardly from said upper wall over the entire length thereof, the upper end of each of said holding walls being bent inwardly to define a slot whereby said holding walls define a female connecting structure, and said reference section includes male connecting structure formed on the lower portion of said reference section over the entire length thereof, said male connecting structure projecting through said slot and having a portion of arrowhead cross-sectional shape received between said holding walls.

7. An assembly according to claim 5, wherein said clamping section has male connecting structure projecting from the upper surface of said clamping section over the entire length thereof and having a portion of arrowhead cross-sectional shape,, and said elastic reference section comprises female connecting structure including a chamber defined in said elastic reference section and having a slot in the lower wall of said chamber over the entire length thereof through which said male connecting structure projects, said lower wall having a shape corresponding to the cross-sectional shape of the upper wall of said clamping section.

8. An assembly according to claim 5, wherein said clamping section has an upper wall of wide V cross-sectional shape and a pair of opposed holding walls projecting upwardly from the sides of said V-shape over the entire length thereof, with the upper ends of said holding walls being located downwardly with respect to the outer edges of said V-shaped wall, the upper end of each of said holding walls being bent inwardly to define a slot, and said elastic reference section comprises a closed chamber therein and male connecting structure formed on the lower wall of said chamber and extending along the entire length thereof, said male connecting structure projecting through said slot and having a portion of arrowhead cross-sectional shape received between said holding walls.

9. An assembly according to claim 1, wherein the upper portion of said support assembly includes a projection on each side thereof formed by partially cutting and bending outwardly a part thereof, each side of said clamping section of said cover member having an inwardly extending protrusion extending the entire length thereof, said support assembly being mounted between said jointing member and said cover member in such a manner that said projections interfit with said protrusions of said clamping section.

10. An assembly according to claim 9, wherein said projections are fitted in and received by a pair of grooves provided on the sides of said clamping section of said cover member over the longitudinal dimension thereof.

11. A joint forming and sealing assembly adapted to be laid in place on a surface prior to forming a slab of concrete or mortar thereon, comprising: an elongated elastic jointing member having substantially the shape of a board and having upper and lower edges and opposite sides; an elongated cover member of inverted substantially U-shape cross section and being sleeved on the upper end of said jointing member, said cover member having a pair of generally parallel, depending legs respectively extending downwardly along the sides of said jointing member from said upper edge partway to said bottom edge, said legs having means defining a series of vertically spaced apart outwardly extending projections on the outer surface thereof capable of extending into the concrete or mortar, said cover member having a pair of intermediate portions extending upwardly and outwardly from the upper ends of said legs with said intermediate portions being disposed above the upper edge of said jointing member, said cover member having a pair of upper portions extending upwardly from the outer ends of said intermediate portions, said upper portions having generally planar upper surfaces defining reference surfaces for use in smoothing the surface of the concrete or mortar; said cover member having a top wall of inverted shallow V-shaped cross section with the apex of said V substantially contacting the upper edge of said jointing member between the sides thereof with the remainder of said top wall being spaced vertically upwardly from said upper edge and said intermediate portions to provide clearances therebetween, the outer edges of said top wall being joined to said upper portions.

12. A joint forming and sealing assembly adapted to be laid in place on a surface prior to forming a slab of concrete or mortar thereon, comprising: an elongated elastic jointing member having substantially the shape of a board and having upper and lower edges and opposite sides; a one-piece elongated cover member comprising a clamping section and an elastic reference section, said clamping section being of inverted substantially U-shape cross section and being sleeved on the upper end of said jointing member, said clamping section having a pair of generally parallel, depending legs respectively extending downwardly along the sides of said jointing member from said upper edge partway to said bottom edge, said reference section being of upright substantially T-shaped cross section and projecting upwardly from the central portion of the upper wall of said clamping section, upwardly extending projections located at the ends of the crossbar of the T and defining reference surfaces for use in smoothing the surface of the concrete or mortar, said reference section having side portions extending downwardly from the ends of the crossbar of the T to positions located close to but spaced upwardly from the upper end of said clamping section.

13. A joint forming and sealing assembly adapted to be laid in place on a surface prior to forming a slab of concrete or mortar thereon, comprising: an elongated elastic jointing member having substantially the shape of a board and having upper and lower edges and opposite sides; an elongated cover member comprising a clamping section and a separable elastic reference section, said clamping section being of inverted substantially U-shape cross section and being sleeved on the upper end of said jointing member, said clamping section having a pair of generally parallel, depending legs respectively extending downwardly along the ends of said jointing member from said upper edge partway to said bottom edge, said reference section projecting upwardly from said clamping section and having a substantially horizontal top wall, a pair of longitudinally extending laterally spaced projections extending upwardly from said top wall at the opposite lateral ends thereof, said projections defining reference surfaces for use in smoothing the surface of the concrete or mortar; said elastic reference section being slidably, detachably and replaceably attached to said clamping section, said clamping section and said elastic reference section having interfitting male and female connecting structures for releasably joining together said sections.

14. An assembly according to claim 13, wherein said clamping section has an upper wall of inverted substantially W cross-sectional shape and a pair of spaced-apart opposed holding walls projecting upwardly from said upper wall over the entire length thereof, the upper end of each of said holding walls being bent inwardly to define a slot whereby said holding walls define a female connecting structure, and said reference section includes male joining connecting structure formed on the lower portion of said reference section over the entire length thereof, said male connecting structure projecting through said slot and having a portion of arrowhead cross-sectional shape received between said holding walls.

15. An assembly according to claim 13, wherein said clamping section includes male connecting structure projecting from the upper surface of said clamping over the entire length thereof and having a portion of arrowhead cross-sectional shape, and said elastic reference section comprises female connecting structure including a chamber defined in said elastic reference section and having a slot in the lower wall of said chamber over the entire length thereof through which said male connecting structure projects, said lower wall having a shape corresponding to the cross-sectional shape of the upper wall of said clamping section.

16. A jointing material according to claim 13, wherein said clamping section has an upper wall of wide V cross-sectional shape and a pair of opposed holding walls projecting upwardly from the sides of said V-shape ovr the entire length thereof with the upper ends of said holding walls being located downwardly with respect to the outer edges of said V-shaped wall, the upper end of each of said holding walls being bent inwardly to define a slot, and said elastic reference section comprises a closed chamber therein and male connecting structure formed on the lower wall of said chamber and extending along the entire length thereof, said male connecting structure projecting through said slot and having a portion of arrowhead cross-sectional shape received between said holding walls.

* * * * *

UNITED STATES PATENT AND TRADEMARK OFFICE

CERTIFICATE OF CORRECTION

PATENT NO. : 4 050 206

DATED : September 27, 1977

INVENTOR(S) : Akira Utsuyama

It is certified that error appears in the above-identified patent and that said Letters Patent are hereby corrected as shown below:

Column 14, line 15; change "ends" to ---sides---.

Column 14, line 44; after "clamping" insert ---section---.

Column 14, line 58; change "ovr" to ---over---.

Signed and Sealed this

*Seventeenth* Day of *May 1983*

[SEAL]

*Attest:*

DONALD J. QUIGG

*Attesting Officer*

*Acting Commissioner of Patents and Trademarks*